US005298794A

United States Patent [19]

Kuragaki

[11] Patent Number: 5,298,794

[45] Date of Patent: Mar. 29, 1994

[54] ELECTRICAL ANTICORROSION DEVICE FOR MARINE PROPULSION DEVICE

[75] Inventor: Naoyoshi Kuragaki, Hamamatsu, Japan

[73] Assignee: Sanshin Kogyo Kabushiki Kaisha, Hamamatsu, Japan

[21] Appl. No.: 833,090

[22] Filed: Feb. 10, 1992

[30] Foreign Application Priority Data

Feb. 8, 1991 [JP] Japan ..... 3-39485

[51] Int. Cl.[5] ..... H01B 7/28

[52] U.S. Cl. ..... 307/95; 440/89; 204/196

[58] Field of Search ..... 307/91, 95; 204/147, 204/196; 440/57, 88, 89, 113, 900; 60/310

[56] References Cited

U.S. PATENT DOCUMENTS

| | | | |
|---|---|---|---|
| 3,830,719 | 8/1974 | Cavil | 204/196 |
| 3,888,203 | 6/1975 | Lohse | 440/57 |
| 3,893,407 | 7/1975 | Hurst | 440/57 |
| 3,935,742 | 4/1976 | Anderson et al. | 307/95 |
| 4,322,633 | 3/1982 | Staerzl | 307/95 |
| 4,492,877 | 1/1985 | Staerzl | 307/95 |
| 4,528,460 | 7/1985 | Staerzl | 307/95 |
| 4,654,013 | 3/1987 | Bland et al. | 440/57 |
| 4,957,461 | 9/1990 | Nakayama | 204/147 X |

*Primary Examiner*—A. D. Pellinen
*Assistant Examiner*—F. M. Fleming
*Attorney, Agent, or Firm*—Knobbe, Martens, Olson & Bear

[57] ABSTRACT

This invention primarily relates to an electrical anticorrosion device for a marine propulsion arrangement. More particularly, the invention relates to a cathodic protection arrangement which is suitable for use with an inboard/outboard propulsion unit. According to the invention, an anode and a reference electrode are housed within a housing unit which is mounted upon a propulsion unit mounting bracket. The two electrodes are arranged so that each is essentially equidistant from a point located approximately midway across the lateral width of an outboard drive unit, which unit is secured to the mounting bracket, when the unit is positioned for driving the associated watercraft in a generally forward direction. The electrode housing further serves as a low speed/idle exhaust gas device which breaks up exhaust gas bubbles which otherwise might cause loud and objectionable noise. Thus, the invention allows for the effective prevention of cathodic corrosion by insuring that a proper current is supplied to a sacrificial anode and, additionally, allows for improved silencing for the low speed/idling exhaust gases of an inboard/outboard drive unit.

20 Claims, 5 Drawing Sheets $\Delta V = V_O - V_R$

ELECTRICAL ANTICORROSION DEVICE FOR MARINE PROPULSION DEVICE

BACKGROUND OF THE INVENTION

This invention relates to an electrical anticorrosion device for a marine propulsion arrangement. More particularly, the invention relates to a cathodic protection arrangement which is suitable for use with such a propulsion unit.

An important group of oxidation-reduction processes are those involved in corrosion. The annual combined cost of corrosion protection and the losses due to corrosion are enormous. This fact lends a particular practical importance to this general subject matter area.

The problem of corrosion is particularly acute when related to the operation of a watercraft in an aqueous environment. Such is especially the case in a marine environment since the salt water greatly accelerates the effects of galvanic corrosion. Galvanic corrosion refers to the accelerated electrochemical corrosion produced when one metal is in electrical contact with another more noble metal, both being in the same corroding medium or electrolyte (e.g., salt water) with a current between them. Corrosion of this type usually results in a higher rate of solution of the less noble metal and protection of the more noble metal.

A number methods (often referred to as "cathodic protection" systems) have been devised over the years in an attempt to prevent galvanic corrosion of the components of various devices and arrangements. One popular method utilized in connection with various watercraft for providing cathodic protection employs an anode and a separate reference electrode wherein current is supplied to the anode to polarize a submersible metal unit, such as a marine drive unit. The potential at the material to be protected, such as the drive unit, is determined with respect to the reference electrode so that a quantity of electrical current can be supplied by an appropriate source of electrical power to the anode to establish and maintain the potential at the protected unit at desired levels which will provide optimal cathodic protection.

U.S. Pat. Nos. 4,492,877 and 4,528,460, both to Staerzl, teach such use of an anode, a reference electrode, and a current control system in connection with watercraft propulsion systems. The '877 patent discloses an electrode apparatus for cathodic protection and the '460 patent discloses a cathodic protection controller. Generally, Staerzl ('877) discloses an electrode apparatus for a cathodic protection system, for mounting on an outboard drive unit, which uses a grounded shield mounted between an anode and a reference electrode to allow the anode and reference electrode to be mounted in close proximity to each other. Generally, the cathodic protection system provided protects the lower unit of a marine stern drive from corrosion by maintaining the lower unit at a selected electrical potential (e.g., 0.94 volts). Staerzl ('460) also teaches a control system for cathodically protecting an outboard drive unit having an anode and a reference electrode mounted thereon. Current supplied to the anode is controlled by a transistor which, in turn, is controlled by an amplifier. The amplifier is biased to maintain a relatively constant potential on the drive unit when operated in either fresh or salt water.

For the sake of convenience and ease of installation of the cathodic protection system, Staerzl has recognized that it is desirable to mount the anode and reference electrode relatively close together within a single housing unit which is readily attachable to a submersible propulsion unit. In the arrangements disclosed in the Staerzl patents, the anode and reference electrode are disposed with one of these electrodes in front of the other electrode, on a line running in a direction longitudinally with respect to an associated watercraft, in an insulating housing unit securable to a bracket unit proximate to which the propulsion unit is attached. Accordingly, the distance from the anode to certain regions of the propulsion unit to be protected is different from the distance between the reference electrode and those same regions.

Although providing some measure of convenience, such an arrangement nevertheless creates certain problems. Due to the aforementioned disparity in distances, the measured potential at the point of reference may differ somewhat from the actual potential whereat anticorrosion protection is required, and which protection is meant to be secured by supplying current to the anode. These prior arrangements, thus, render it difficult to ascertain an accurate measurement of the potential at the protected regions of the propulsion unit, and therefore to supply the correct current to the anode in order to adequately protect those regions of the propulsion unit from corrosive damage. Also, it is difficult to protect against possible damage to the anode arrangement, because excessive anode current can cause damage to portions of the anode arrangement.

It is therefore a principle object of the present invention to provide an improved electrical anti-corrosion device suitable for use with a marine propulsion arrangement.

It is a further object of the invention to provide a cathodic protection arrangement which permits for the effective prevention of cathodic corrosion by insuring that a proper current is supplied to an anode.

In addition to the problem of galvanic corrosion, there is also the problem of the treatment of the exhaust gases generated during operation of a watercraft propulsion arrangement. The treatment of exhaust gases in marine propulsion units and particularly outboard drives is a troublesome one. It is well known to discharge the exhaust gases from the powering engine through an underwater exhaust gas discharge so as to utilize the body of water in which the watercraft is operating as a silencing medium. Although this is a very acceptable and effective way for silencing exhaust gases under high speed running conditions, it does present certain problems in connection with low speed exhaust gas discharge. With an outboard motor, it is the common practice to provide a separate, above the water, exhaust gas discharge which has its own silencing system for treating the idling exhaust gases. With inboard/-outboard drives, on the other hand, the powering engine usually has a larger displacement and the treatment of the exhaust gases during idling presents different problems. It has been proposed with such arrangements to employ a further auxiliary exhaust gas discharge which is also underwater when the boat is traveling at low speeds but is less deeply submerged than the high speed exhaust gas discharge. Although this does provide good silencing, the exhaust gases tend to emanate in large bubbles which can cause objectionable noise.

It is therefore yet a further object of the present invention to provide an improved exhaust gas discharge for a marine propulsion unit.

It is another object of this invention to provide an improved underwater exhaust gas discharge for a marine inboard/outboard drive unit.

It is still a further object of this invention to provide an improved silencing arrangement for the idling exhaust gases of an inboard/outboard drive unit.

SUMMARY OF THE INVENTION

A first feature of the present invention is adapted to be embodied in an electrical anticorrosion device for a watercraft drive arrangement. This first feature comprises a metallic arrangement to be protected against cathodic corrosion and a mounting bracket for mounting the metallic arrangement. An anode and a reference electrode are provided within a housing unit which is positioned upon the mounting bracket. A current supply and regulation arrangement is provided which is in electrical communication with the anode, the reference electrode, and the metallic arrangement. The current supply and regulation arrangement is operative to maintain the metallic arrangement at a desired electrical potential in order to protect it from corrosion. The anode and the reference electrode each are positioned essentially equidistantly from a point located approximately midway across the lateral width of the metallic arrangement.

A second feature of the invention is adapted to be embodied in an electrical anticorrosion device for an inboard/outboard propulsion system. This second feature comprises an outboard drive portion to be protected against cathodic corrosion and a mounting bracket for mounting the outboard drive portion. The arrangement further comprises an anode and a reference electrode. An exhaust gas baffle plate arrangement is positioned upon the mounting bracket so that the baffle plate houses the anode and the reference electrode. A current supply and regulation arrangement is provided which is in electrical communication with the anode, the reference electrode, and the outboard drive portion. The current supply and regulation arrangement is operative to maintain the outboard drive portion at a desired electrical potential in order to protect it from corrosion. The anode and the reference electrode each are positioned essentially equidistantly from a point located approximately midway across the lateral width of the outboard propulsion portion when the outboard propulsion portion is positioned for driving an associated watercraft in a generally forward direction.

A third feature of the invention is adapted to be embodied in an electrical anticorrosion system for preventing galvanic corrosion within a watercraft propulsion arrangement. This third feature comprises an anode, a reference electrode, and a current supply system connected to the anode and the reference electrode. The current supply system is further connected to an outboard propulsion portion of the watercraft propulsion arrangement, in order to protect it from corrosion. An exhaust gas baffle plate is provided which houses the anode and the reference electrode. A low speed and idle operation exhaust gas outlet is provided and is positioned beneath the surface of a body of water within which an associated watercraft is operated during low speed and idle running maneuvers thereof. The exhaust gas baffle plate covers the low speed and idle exhaust gas outlet for restricting the effective size of the outlet and redirecting the flow of exhaust gases emanating from the outlet in order to break up the size of exhaust gas bubbles emanating from the outlet and for improving silencing at idle and low speeds. Additionally, the anode and the reference electrode each are positioned essentially equidistantly from a point located approximately midway across the lateral width of the outboard propulsion portion when the outboard propulsion portion is positioned for driving an associated watercraft in a generally forward direction.

DETAILED DESCRIPTION OF THE PREFERRED EMBODIMENT

Figure 1:
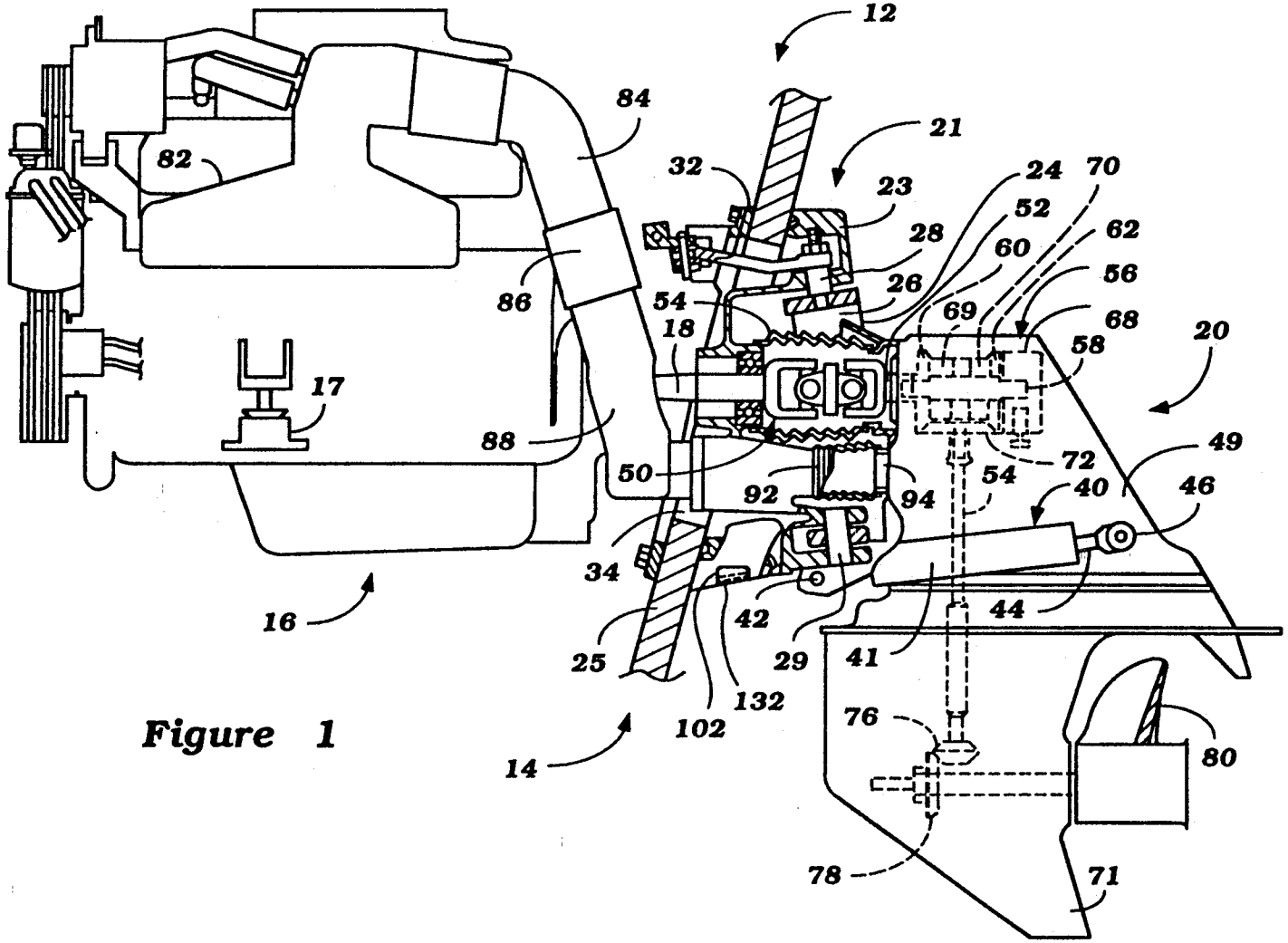
FIG. 1 is a side elevational view of a portion of a watercraft powered by an inboard/outboard drive constructed in accordance with, and embodying, the present invention.

Referring now in detail to the drawings, and initially to FIG. 1, a watercraft powered by an inboard/outboard drive constructed in accordance with the present invention is shown in part and is indicated generally by the reference numeral 12. The watercraft is comprised of a hull 14 in which an internal combustion engine 16 of any known type is positioned via engine mounting units 17. The engine 16 drives an engine output shaft 18 which leads to an outboard drive unit indicated generally by the reference numeral 20.

An intermediate unit 21 is located between the engine 16 and the propulsion unit 20. The intermediate unit 21 is comprised of a number of components, including a transom plate or gimbal housing 23 that is adapted to be affixed, in a known manner, to a transom 25 of the associated watercraft 12. A gimbal ring 26 is affixed to the gimbal housing 23 and is supported for steering movement about a generally vertical axis extending through a tilt bracket 24 and defined by upper and lower pivot shafts 28 and 29, respectively. Such steering movement is accomplished by way of a steering lever 32 which is connected along a portion of the upper pivot shaft 28 and which extends forwardly, through an aperture 34 of the transom 25, towards a suitable steering line which, in turn, ultimately leads to a remotely placed operator controlled steering device (not shown).

Figure 2:
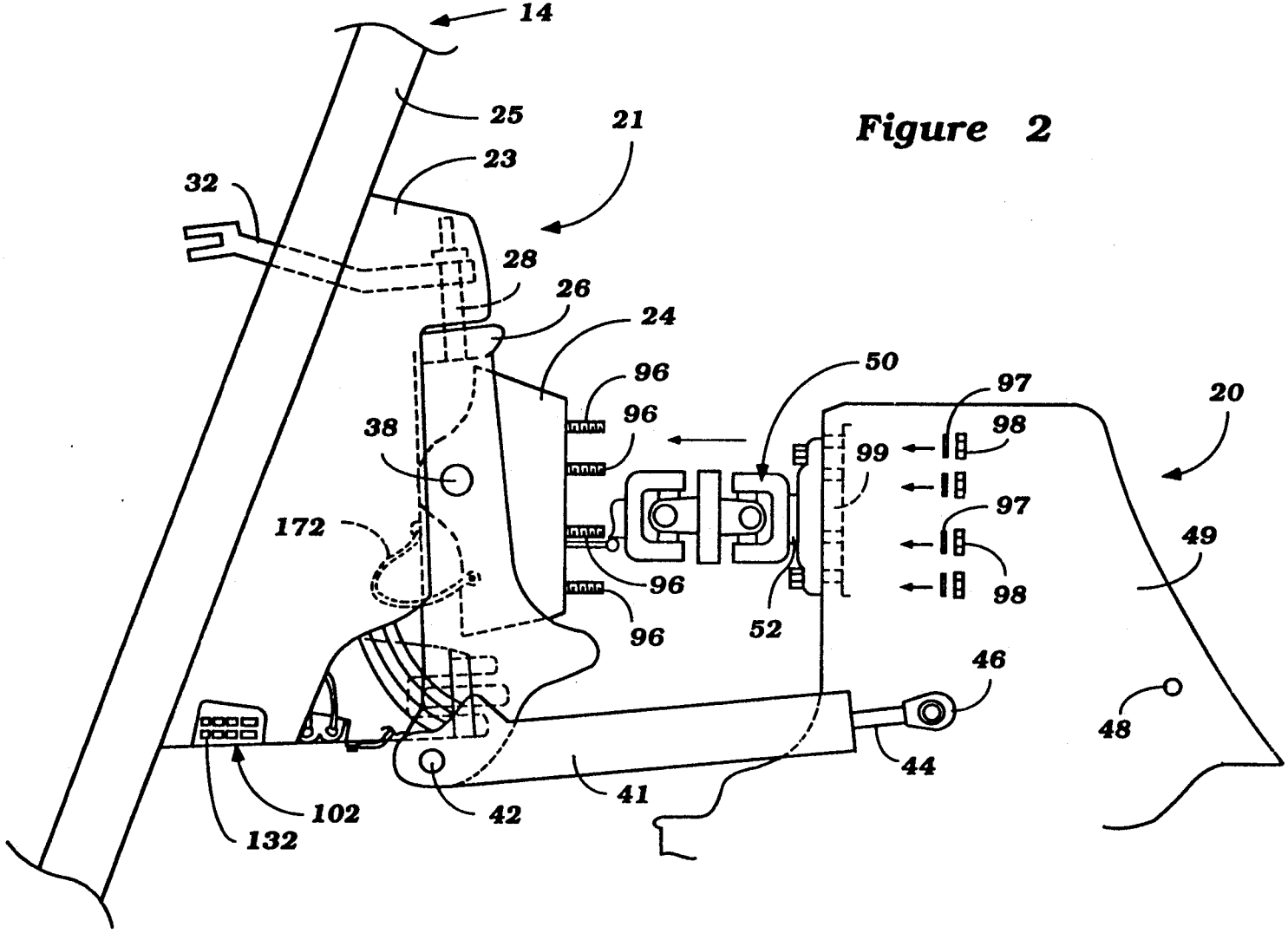
FIG. 2 is an exploded view of the mounting arrangement for the outboard drive unit of the watercraft propulsion arrangement.
Figure 3:
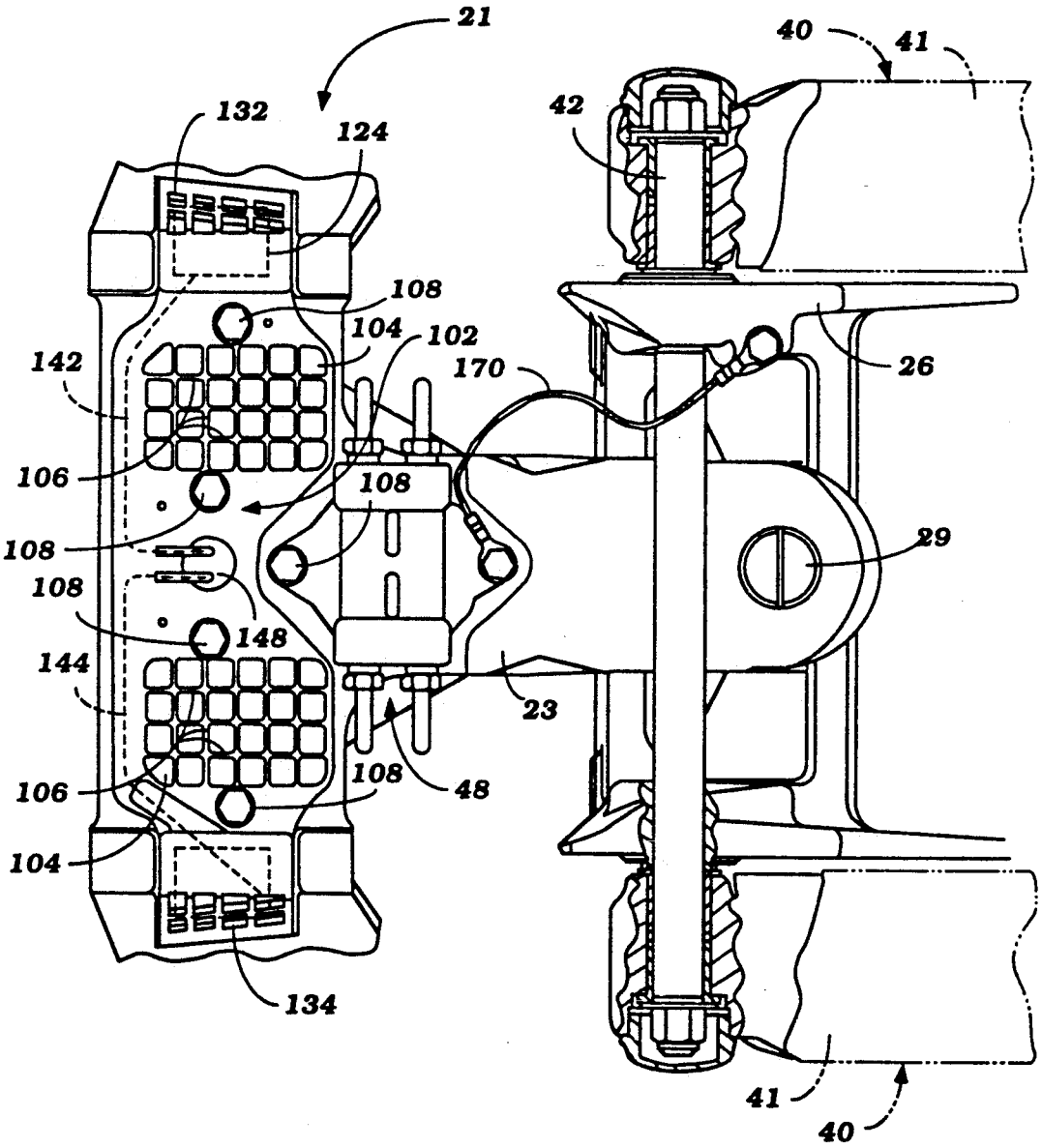
FIG. 3 is a plan view from beneath the watercraft of the invention showing portions of the electrical anticorrosion arrangement and a low speed/idle exhaust gas discharge region.

Referring now additionally to FIGS. 2 and 3, it can be seen that the intermediate unit 21 is provided with a pivotal connection, approximately midway along the length of the gimbal ring 26, comprising a pair of tilt pins 38 which define a generally horizontally extending axis about which the propulsion 20 unit may be pivoted between a plurality of trim and tilt adjusted positions.

Such tilt and trim movement of the outboard drive 20 relative to the gimbal ring 26 is controlled by means of hydraulically operated cylinder assemblies 40, with one such cylinder assembly located towards each lateral side of the propulsion unit 20 (See FIG. 3). The cylinder assemblies 40 include cylinder units 41 which are connected to a lower portion of the gimbal ring 26 at one end by means of a pivot shaft 42. A piston rod 44 of each cylinder assembly 40 has a trunion portion 46 that is connected by means of a pivot pin 48 to a rearwardly located portion of an upper casing 49 of the housing of the propulsion unit 20. An oil distributor unit 48 (FIG. 3) is provided for supplying pressurized fluid to a fluid chamber within each cylinder 41 in response to control signals which indicate the tilt or trim position which is desired. As a result, extension of the piston rods 44 will effect pivotal movement of the housing assembly of the propulsion unit 20 about the tilt pins 38.

With particular reference once again to FIG. 1, it can be seen that the output shaft 18 extending from the engine 16 is coupled by way of a universal joint 50 to an input shaft 52 of a transmission arrangement for the outboard drive unit 20. A protective flexible bellows 54 envelops the universal joint 50 between the gimbal housing 23 and the upper casing portion 49 of the housing of the propulsion unit 20. The input shaft 52 can selectively drive a driveshaft member 54 by means of a hydraulically operated, bevel gear type forward, neutral, reverse transmission arrangement, indicated generally by the reference numeral 56, which is described next.

A clutch shaft 58 extends rearwardly of the transmission input shaft 52. A forward gear 60 and a reverse gear 62 are journaled about the clutch shaft 58 with their toothed faces diametrically opposed with respect to one another. The hydraulic clutch arrangement 56, which includes a hydraulic control device 68 and a pair of clutch elements 69 and 70, for the forward 60 and reverse 62 gears, respectively, is operated to determine the rotational direction in which the driveshaft 52 is driven, if it is to be driven at all, via a driven gear 72 which is mounted at an upper portion of the driveshaft 54.

The drive imparted to the driveshaft 54 is transmitted to a propeller driveshaft 74 by way of a further bevel gear arrangement located in a lower casing 71 of the propulsion unit 20. This further bevel gear arrangement includes a pinion 76 journaled about the lower end of the drive shaft 54 and a bevel gear 78 journaled about a forward portion of the propeller driveshaft 74. A propeller 80 is fixed at the rearwardmost end of the propeller driveshaft 74. The propeller 80 is powered selectively via the transmission arrangement, just described, so as to propel the associated watercraft 12 along a body of water as desired.

The internal combustion engine 16 has a plurality of exhaust ports (not shown) that open into an exhaust manifold 82. The engine exhaust gases produced by the engine 16 flow from the manifold 82 into a conduit 84. The exhaust gases are discharged from the conduit 84 through a coupling 86 into a collector section 88. The collector section 88 defines a main exhaust gas passageway that mates with a corresponding exhaust gas passageway 90 of the gimbal housing 23. A flexible bellows 92 interconnects the gimbal housing passageway 90 with an exhaust gas passage 94 (shown partially) formed in the outboard drive casings 49 and 71 and which terminates in a through the hub exhaust gas discharge (not shown) of the propeller 80. Of course, other forms of high speed exhaust gas discharges may be employed.

It should be noted, as shown in FIG. 2, that the propulsion unit 20, including the upper and lower casings 49 and 71 and their associated components as set forth above, is attachable to the intermediate unit by way of a plurality of threaded bolt members 96 which extend rearwardly from the tilt bracket 24 and a plurality of mating washer 97 and nut 98 pairs which may be fastened thereto. A fixture assembly 99, which comprises a main support structure for the propulsion unit 20, is receivable about the shafts of the bolt members 96 and is interposed between a rearward face of the swivel bracket 24 and the washer/nut pairs 97 and 98. In this way, the propulsion unit is secured in place with respect to the rest of the watercraft 12.

Conversely, the propulsion unit 20 may be readily detached from the watercraft 12. The washer/nut pairs 97 and 98 can be unfastened from their corresponding bolt members 96. The piston rod 44 of each cylinder assembly 40 can also be detached from the propulsion unit 20 by disconnecting each trunion portion 46 from its respective pivot shaft 48 located along the rearward region of the upper casing 49 of the propulsion unit 20. The engine output shaft 18 may have a splined connection with the output region for the crankshaft (not shown) of the engine 16 so that it can be slid away from the engine, when desired. The bellows members 54 and 92 may also be constructed so that they can be readily detached from their corresponding points of connection to propulsion unit 20. Thus, the propulsion unit 20 can be easily removed to enable ready servicing of any of the arrangement, as necessary.

Next, the anti-corrosion electrode arrangement and low speed/idle exhaust gas discharge, as contemplated by the present invention, will be described as embodied in combination with the watercraft set forth above.

The through the hub exhaust gas discharge opening is extremely effective in silencing the high speed exhaust gases from the engine 16. However, when operating at lower speeds, or during idle, the degree of submersion of the underwater high speed discharge is too great to allow the idling gases to readily pass therethrough, and the back pressure of the idling gases of the engine 16 will be so high as to impede efficient operation of the propulsion arrangement. For that reason, there is provided an idling exhaust gas discharge that is comprised of a pair of passages (not shown) that intersect, at their inlet ends, the passage formed in the collector 88, and which terminate in a pair of downwardly facing passageways that have outlet openings 98 (FIG. 4) formed at their lower ends. The outlet openings 98 are normally positioned beneath the water level when the watercraft is stationary, idling or under low speed running conditions. This construction, which is of the type generally employed in the prior art, is intended to provide exhaust gas silencing for low or idle running. However, the discharge of the idling gases causes rather large exhaust gas bubbles to form which are noisy when breaking up.

In accordance with the invention, therefore, there is provided a baffle plate member, indicated generally by the reference numeral 102, mounted across the outlet openings 98, which cooperate with the openings 98 in order to break up these bubbles and to provide effective silencing. General details of such an auxiliary exhaust gas outlet and baffle arrangement are set forth in U.S. Pat. No. 4,957,461 to Nakayama, and assigned to the assignee hereof.

Figure 4:
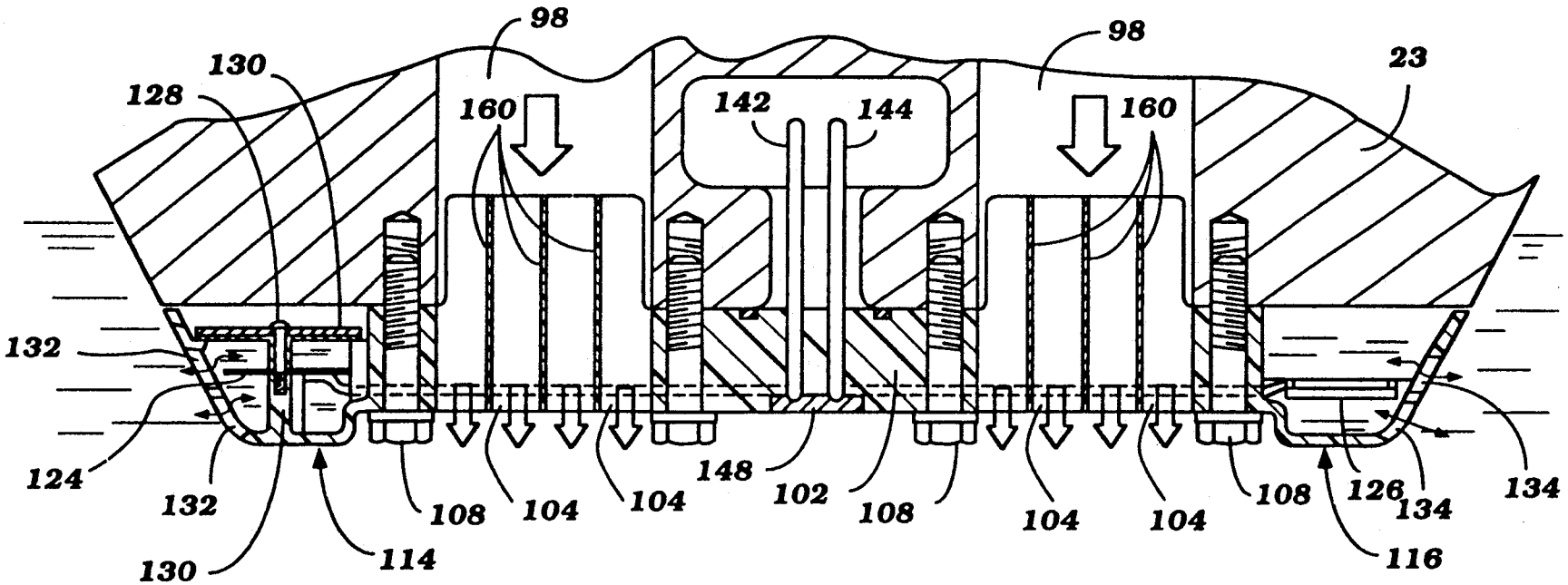
FIG. 4 is a sectional view taken through the electrical anticorrosion arrangement and low speed/idle exhaust gas discharge of the watercraft as constructed in accordance with the present invention.

As may best be seen in FIGS. 3 and 4, the baffle 102 is comprised of a set of exhaust gas receiving openings 104 which are generally aligned, and register, with the discharge openings 98. The lower face of the baffle 102 is formed with a plurality of projecting ribs 106 that define a number of pockets which, in effect, provide a labyrinth type device so that the exhaust gases must flow through a plurality of the pockets before they can enter into the body of water in which the watercraft 12 is operating. As a result, the exhaust gas bubbles will be broken up into very small sizes and their rupturing will not cause an objectionable sound. In addition, the use of the baffles formed by the ribs 106 provides additional silencing by itself, apart from the breaking up of potentially large exhaust bubbles, so as to insure against objectionable noises during idling. The baffle plate 102 is formed with a plurality of openings that are adapted to pass threaded fasteners 108 so as to afford a means of attachment to the underside of the gimbal housing 23.

The baffle plate 102 serves an additional function as an electrode case for the anti-corrosion electrode arrangement of the present invention; thus, the term "electrode case" as employed hereinafter refers to element 102, as does the term "baffle plate" as employed above.

The electrode case 102 is formed of any suitable resin material, and includes an insulating material comprising the regions thereof denoted by the reference numerals 114 and 116 whereat compartments for housing the electrodes (124 and 126) are located. An anode 124 is positioned to a lateral side of the electrode case 102, proximate the region 114. A reference electrode 126 is positioned to the other lateral side of the electrode case, proximate the region 116.

The anode 124 is held in place by a screw member 128 which is received within a protuberance 130 of the electrode case 102. The screw member 128 is made of a plastic material in order to avoid corrosion. The screw member 128 further secures a cover member 130 in place at a location above the anode 124. The underside of the cover 130 and the inner boundaries of the electrode case 102 proximate the anode 124 form a compartment for containing the anode 124. A set of openings 132 adjacent to the anode 124 allow water to flow in and out of the compartment housing the anode 124.

A somewhat similar compartment is formed about the reference electrode 126 by the inner boundaries of the electrode case proximate thereto. Also, a further set of openings 134 are located through the casing 102 proximate the reference electrode 126 for allowing water to flow in and out of the compartment.

As can best be seen in FIG. 4, the compartments encasing the anode 124 and the reference electrode 126 are positioned laterally outward of the exhaust ports 104, discussed above, to each side of the electrode case 102. Further, the openings 132 and 134 allowing water to flow through these compartments are formed through the endmost lateral sides of the electrode case 102.

A lead wire 142 communicating with the anode 124 and a lead wire 144 communicating with the reference electrode 126 extend from their respective electrodes generally horizontally across the electrode case, and subsequently turn upwardly and extend through the central region of the electrode case 102. A cover member 148 is embedded within the electrode case 102 directly beneath the lead wires 142 and 144 along the region at which the lead wires 142 and 144 turn upwardly and begin their vertical ascent. The lead wires ultimately connect with a current control circuit 152, as shown schematically in FIG. 5, at their ends remote from the ends which connect to the electrodes 124 and 126. The current control circuit 152, in turn, communicates with a reference voltage memory circuit 154. Together, the circuits 152 and 154 form a general control circuit assembly 156.

Figure 5:
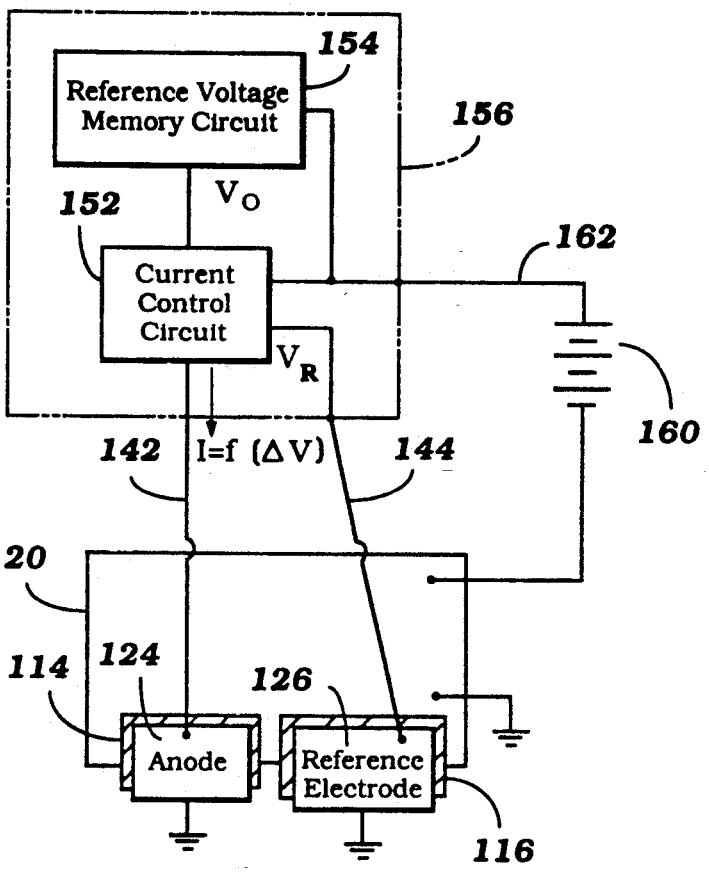
FIG. 5 is a circuit diagram of the current supply and regulation arrangement for the anticorrosion system of the present invention.
Figure 6:
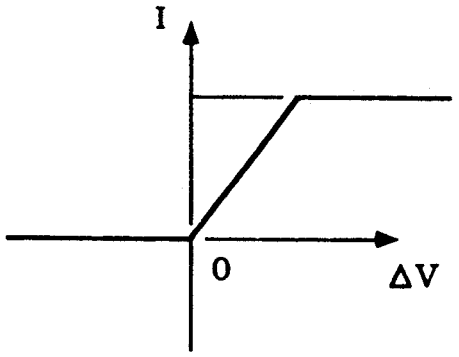
FIG. 6 is a graph which shows the current control characteristics of the circuit of FIG. 5.

As seen in FIG. 5, the insulating portions 114 and 116 electrically insulate the anode 124 and the reference electrode 126, respectively, from both the propulsion unit 20 and from each other. A multicell source of electric current, such as a battery 160, is provided along a conductive line 162 which interconnects the circuits, 152 and 154, of the control circuit 156 with the propulsion unit 20. The negative terminal of the power source 160 communicates with the propulsion unit 20 and the positive terminal of the power source 160 communicates with the control circuit 156. The control circuit 156 senses the potential difference between the reference electrode 126 and the material to be protected and determines the proper electrical current necessary to supply to the anode 124, which is subsequently imparted to the material to be protected, for the optimal cathodic protection effect. Such potential is maintained by allowing current to flow along the lead wire 142 communicating the anode 124 with the control circuit 156 in the direction indicated by the arrow. FIG. 6 is a graph which shows the current control characteristics of the circuit of FIG. 5.

The gimbal housing 23 and the gimbal ring 26 are electrically connected via a conductive wire 170, as best seen in FIG. 3. The gimbal ring 26 and the tilt bracket 24 are electrically connected via a further conductive wire 172, as best seen in FIG. 2. Accordingly, the components of the intermediate unit 21 and the propulsion unit 20 are in electrical communication with one another. In this way, both of these assemblies share a common potential and are afforded cathodic protection by the arrangement of the invention.

Several important advantages are provided by the construction of the cathodic arrangement as detailed above and in the drawings When the propulsion unit is disposed so that its longitudinal axis is generally perpendicular to the plane of the transom 25, the distance from the anode 124 to the propulsion unit 20 is essentially the same as the distance from the reference electrode 120 to the propulsion unit 20. Therefore, the current necessary to supply to the anode 124 in order to maintain the desired potential for the most effective cathodic protection will be readily determinable. Additionally, the possibility of inadvertently supplying an excessive amount of current to the anode 124 can be avoided, since the control circuit assembly 156 will have an accurate indication of the actual present potential at the material to be protected.

Concerning the assembly of the overall propulsion arrangement, the propulsion unit 20 may be readily attached to the watercraft 12, regarding mechanical details, as set forth above. Since the anode 124 and reference electrode 126 may both be attached to the intermediate unit within a convenient common housing unit 102, all that needs to be done to complete the necessary electrical connections for the cathodic protection to be effective, after attachment of the propulsion unit 20, is connecting the lead wires 142 and 144 with the control circuit assembly 156. It can thus be seen that a very simple assembly operation is provided by this invention.

The placement of the anode 124 and the reference electrode 126 towards each lateral side-end of the electrode case 102 allows for the provision of an adequate distance between these electrodes so that an appropriate reference signal indicative of the potential between the protected unit and the reference electrode 126 can be achieved. Further, the interposition of the electrode case 102 between the anode 124 and the propulsion unit 20 provides a sufficient electrically insulated distance between these elements.

It should be noted that the anode 124 and the reference electrode 126 are disposed essentially equidistantly from each of the laterally spaced exhaust ports 104 on the underside of the intermediate unit 21. Thus, any influence which the exhaust gases might have upon the anode 124 will equally influence the reference electrode 126, thereby helping to avoid potential inaccuracies due to any physical externalities associated with the exhaust gases. Further, although the anode 124 and the reference electrode 126 are located nearby the exhaust gas exit ports 102, they are not directly exposed to the exhaust gases. Thus, the reliability of these electrodes can remain very high.

It should be readily apparent from the foregoing description that a very effective exhaust gas baffle and cathodic protection arrangement has been provided. Therefore, not only will the exhaust gases be effectively silenced, but corrosion protection is improved over the prior arrangements. Furthermore, the outboard propulsion unit and the housing for the cathodic protection system can be readily removed in order to provide good access for servicing.

The foregoing description is, of course, only that of a preferred embodiment of the invention, and various changes and modifications may be made without departing from the spirit and scope of the invention, as defined by the appended claims.

It is claimed:

1. An electrical anticorrosion device for a watercraft drive arrangement, comprising: a metallic arrangement to be protected against cathodic corrosion; a mounting bracket for mounting said metallic arrangement; an anode; a reference electrode; a housing unit positioned upon said mounting bracket, wherein said housing unit houses said anode and said reference electrode; a current supply and regulation arrangement; wherein said current supply and regulation arrangement is in electrical communication with said anode, said reference electrode, and said metallic arrangement; and further, wherein said current supply and regulation arrangement is operative to maintain said metallic arrangement at a desired electrical potential in order to protect it from corrosion; and wherein said anode and said reference electrode each are positioned essentially equidistantly from a point located approximately midway across the lateral width of said metallic arrangement; wherein said anode and said reference electrode each are positioned along a lien which si oriented across the lateral width of said mounting bracket.

2. The electrical anticorrosion device of claim 1 wherein said metallic arrangement is an outboard propulsion portion of said watercraft drive arrangement; and wherein said anode and said reference electrode are arranged so that each is essentially equidistant from a point located approximately midway across the lateral width of said outboard propulsion portion when said outboard propulsion portion is positioned for driving an associated watercraft in a generally forward direction.

3. The electrical anticorrosion device of claim 2 wherein said mounting bracket is a gimbal housing; and further comprising a gimbal ring disposed within said gimbal housing for pivotal movement about a generally vertically extending axis, and a tilt bracket disposed within said gimbal housing for pivotal movement about a generally horizontally extending axis.

4. The electrical anticorrosion device of claim 3 wherein said gimbal housing, said gimbal ring and said tilt bracket together comprise an intermediate unit; and wherein said intermediate unit is in electrical communication with said outboard propulsion portion.

5. The electrical anticorrosion device of claim 4 wherein said gimbal housing is in electrical communication with said gimbal ring; and wherein said gimbal ring is in electrical communication with said tilt bracket.

6. The electrical anticorrosion device of claim 5 wherein at least a portion of said housing unit is comprised of an electrically insulating resin material.

7. The electrical anticorrosion device of claim 6 wherein said current supply and regulation arrangement comprises a control circuit assembly, said control circuit assembly including a current control circuit and a reference voltage memory circuit, and a battery; wherein said battery includes a positive terminal which communicates with said control circuit assembly and a negative terminal which communicates with said outboard propulsion portion.

8. The electrical anticorrosion device of claim 7 wherein said watercraft drive arrangement is an inboard/outboard propulsion system.

9. The electrical anticorrosion device of claim 8 further comprising an exhaust gas baffle plate, wherein said housing unit is integrally formed with said exhaust gas baffle plate and said exhaust gas baffle plate is affixed to a lower portion of said mounting bracket.

10. The electrical anticorrosion device of claim 9 further comprising a tilt and trim arrangement for adjusting the disposition of said outboard propulsion portion about a generally horizontally extending axis; wherein said tilt and trim arrangement includes a hydraulic cylinder having one of its ends attached proximate to said gimbal ring and having its other end detachably secured to said outboard propulsion portion.

11. The electrical anticorrosion device of claim 10 wherein said outboard propulsion portion is detachably secured to said tilt bracket via threaded fastening devices.

12. The electrical anticorrosion device of claim 11 wherein said watercraft drive arrangement includes a low speed and idle operation exhaust gas outlet which is positioned beneath the surface of a body of water within which an associated watercraft is operated during low speed and idle running maneuvers thereof; and wherein said exhaust gas baffle plate covers said low speed and idle exhaust gas outlet for restricting the effective size of said outlet and redirecting the flow of exhaust gases emanating from said outlet in order to break up the size of exhaust gas bubbles emanating from said outlet and for improving silencing at idle and low speeds.

13. The electrical anticorrosion device of claim 12 wherein said anode is positioned to one lateral side of said exhaust gas baffle plate, laterally outward of said low speed and idle exhaust gas outlet, and said reference electrode is positioned to the other lateral side of said exhaust gas baffle plate, laterally outward of said outlet.

14. An electrical anticorrosion device for an inboard/outboard propulsion system, comprising: an outboard drive portion to be protected against cathodic corrosion; a mounting bracket for mounting said outboard drive portion; an anode; a reference electrode; an exhaust gas baffle plate arrangement positioned upon said mounting bracket, wherein said baffle plate houses said anode and said reference electrode; a current supply and regulation arrangement; wherein said current supply and regulation arrangement is in electrical communication with said anode, said reference electrode, and said outboard drive portion; and further, wherein said current supply and regulation arrangement is operative to maintain said outboard drive portion; and further, wherein said current supply and regulation arrangement is operative to maintain said outboard drive portion at a desired electrical potential in order to protect it from corrosion; and wherein said anode and said reference electrode each are positioned essentially equidistantly from a point located approximately midway across the lateral width of said outboard drive portion when said outboard drive portion is positioned for driving an associated watercraft in a generally forward direction; wherein said anode and said reference electrode each are positioned along a line which is oriented across the lateral width of said mounting bracket.

15. The electrical anticorrosion device of claim 14 wherein said inboard/outboard propulsion system includes a low speed and idle operation exhaust gas outlet which is positioned beneath the surface of a body of water within which an associated watercraft is operated during low speed and idle running maneuvers thereof; and wherein said exhaust gas baffle plate covers said low speed and idle exhaust gas outlet for restricting the effective size of said outlet and redirecting the flow of exhaust gases emanating from said outlet in order to break up the size of exhaust gas bubbles emanating from said outlet and for improving silencing at idle and low speeds.

16. The electrical anticorrosion device of claim 15 wherein said anode is positioned to one lateral side of said exhaust gas baffle plate, laterally outward of said low speed and idle exhaust gas outlet, and said reference electrode is positioned to the other lateral side of said exhaust gas baffle plate, laterally outward of said outlet.

17. The electrical anticorrosion device of claim 16 wherein said current supply and regulation arrangement comprises a control circuit assembly, said control circuit assembly including a current control circuit and a reference voltage memory circuit, and a battery; wherein said battery includes a positive terminal which communicates with said control circuit assembly and a negative terminal which communicates with said outboard drive portion.

18. An electrical anticorrosion system for preventing galvanic corrosion within a watercraft propulsion arrangement, comprising: or anode; a reference electrode; a current supply system connected to said anode and said reference electrode, said current supply system further connected to an outboard propulsion portion of said watercraft propulsion arrangement in order to protect it from corrosion; an exhaust gas baffle plate housing said anode and said reference electrode; a low speed and idle operation exhaust gas outlet which is positioned beneath the surface of a body of water within which warn associated watercraft is operated during low speed and idle running maneuvers thereof; and wherein said exhaust gas baffle plate covers said low speed and idle exhaust gas outlet for restricting the effective size of said outlet and redirecting the flow of exhaust gases emanating from said outlet in order to brake up the size of exhaust gas bubbles emanating from said outlet and for improving silencing at idle and low speeds; wherein said anode and said reference electrode each are positioned essentially equidistantly from a point located approximately midway across the lateral width of said outboard propulsion portion when said outboard propulsion portion is positioned for driving an associated watercraft in a generally forward direction; wherein said anode and said reference electrode each are positioned along a laterally oriented line which runs in a direction generally perpendicular to a longitudinal center line of the associated watercraft.

19. The electrical anticorrosion system of claim 18 further comprising a mounting bracket for mounting said outboard propulsion portion; and wherein said exhaust gas baffle plate is secured to said mounting bracket.

20. The electrical anticorrosion system of claim 19 wherein said current supply system comprises a control circuit assembly, said control circuit assembly including a current control circuit and a reference voltage memory circuit, and a battery; wherein said battery includes a positive terminal which communicates with said control circuit assembly and a negative terminal which communicates with said outboard propulsion portion.

* * * * *

UNITED STATES PATENT AND TRADEMARK OFFICE

CERTIFICATE OF CORRECTION

PATENT NO. : 5,298,794

DATED : March 29, 1994

INVENTOR(S) : Naoyoshi Kuragaki

It is certified that error appears in the above-indentified patent and that said Letters Patent is hereby corrected as shown below:

Column 9, line 60, Claim 1, "lien", should be --line--;

Same line, "si" should be --is--.

Column 12, line 17, Claim 18, "warn", should be --an-- .

Signed and Sealed this

Twenty-third Day of August, 1994

*Attest:*

*Attesting Officer*

BRUCE LEHMAN

*Commissioner of Patents and Trademarks*